US005271649A

United States Patent [19]

Gromotka

[11] Patent Number: 5,271,649

[45] Date of Patent: Dec. 21, 1993

[54] OVER CENTER DRAW LATCH WITH LOCK BOLT ACTION

[75] Inventor: Gabriel Gromotka, Caledonia, N.Y.

[73] Assignee: Southco, Inc., Concordville, Pa.

[21] Appl. No.: 999,167

[22] Filed: Dec. 31, 1992

[51] Int. Cl.[5] ..... E05C 5/02

[52] U.S. Cl. ..... 292/113; 292/304; 292/DIG. 40

[58] Field of Search ..... 292/113, 247, 304, DIG. 40, 292/DIG. 42, DIG. 49

[56] References Cited

U.S. PATENT DOCUMENTS

| | | | |
|---|---|---|---|
| 1,603,418 | 10/1926 | Scheider | 292/113 |
| 3,030,137 | 4/1962 | Cheney | 292/113 |
| 3,174,784 | 3/1965 | Swanson | 292/113 |
| 3,181,905 | 5/1965 | Bisbing | 292/109 |
| 3,466,076 | 9/1969 | Bisbing | 292/109 |
| 4,023,839 | 5/1977 | Bisbing | 292/85 |
| 4,049,301 | 9/1977 | Schenk | 292/113 |
| 4,074,549 | 2/1978 | Yee | 292/247 X |
| 4,181,333 | 1/1980 | Stelma | 292/113 X |
| 4,230,351 | 10/1980 | Bisbing | 292/223 |
| 4,428,608 | 1/1984 | Cooke et al. | 292/247 |
| 4,687,237 | 8/1987 | Bisbing | 292/78 |
| 4,705,308 | 11/1987 | Bisbing | 292/108 |
| 4,804,215 | 2/1989 | Bisbing | 292/113 |
| 4,890,869 | 1/1990 | Langkamp, Jr. | 292/113 |
| 4,917,421 | 4/1990 | Wightman et al. | 292/247 |
| 5,110,120 | 5/1992 | Smolucha | 292/113 X |

*Primary Examiner*—Richard E. Moore
*Attorney, Agent, or Firm*—Paul & Paul

[57] ABSTRACT

An over center draw latch with lock bolt action which performs the functions of both a bolt type latch and a draw type latch. The latch comprises a housing mounted on one panel, a lever rotatably mounted on the housing, a spring rotatably mounted on the lever and a keeper mounted on another panel. When the latch is fastened, the spring engages the keeper to thereby draw the panels together. In addition, a portion of the lever engages the keeper to provide a lock bolt action. In the closed position, the latch prevents relative movement of the panels in all directions.

13 Claims, 3 Drawing Sheets

OVER CENTER DRAW LATCH WITH LOCK BOLT ACTION

BACKGROUND OF THE INVENTION

The present invention relates to latches for doors, panels and the like. In particular, the invention relates to an over center draw latch with lock bolt action that comprises relatively few components and performs the functions of both a draw latch and a lock bolt latch.

A common type of fastener is the bolt latch, which comprises a bolt assembly that is mounted onto a door and a keeper that is mounted on the door frame and designed to receive the bolt. Engagement of the bolt within the keeper secures the door in the closed position. An example of such a latch is the common door dead bolt. A major disadvantage of conventional dead bolt assemblies is that the bolt can become jammed in the keeper when a side load is applied between the panels, e.g., when a load is applied between the door and door frame. This is particularly a problem in spring retractable bolt assemblies where the only force drawing the bolt back is provided by a spring. Also, the number of components required in a spring retractable bolt latch is relatively large.

Another type of fastener is the draw latch, which consists of two parts mounted on separate panels. When the draw latch is fastened it pulls the panels together. Conventional draw type latches are disclosed in U.S. Pat. Nos. 3,181,905; 3,466,076; 4,705,308 and 4,804,215. While such draw latches are effective at pulling panels together in the plane of the panels, relative movement in other directions is not prevented.

Combination bolt and draw latches are also known in which the latch both draws panels together and restricts relative movement of the panels in the other directions. However, conventional combination latches are relatively complex and require a large number of components, which adds to their cost.

The present invention has been developed in view of the foregoing and to overcome the deficiencies of the prior art.

SUMMARY OF THE INVENTION

An object of the present invention is to provide a novel over center draw latch with lock bolt action.

Another object of the present invention is to provide a latch comprising a housing that may be attached to a panel, a lever rotatably mounted on the housing, a spring rotatably mounted on the lever and a keeper that may be mounted on another panel. The keeper engages the spring to draw the housing toward the keeper to thereby fasten the panels together. The assembly is classified as an over center latch because, when the latch is in the closed position, the center of rotation of the spring is located closer to the plane of the panel than the center of rotation of the lever, thereby biasing the latch in the closed position. Lock bolt action is provided by a portion of the lever that engages within the keeper when the latch is closed.

A further object of the present invention is to provide an over center draw latch with lock bolt action that prevents relative movement of panels in all directions when the latch is fastened.

These and other objects of the present invention will become more readily apparent from the following description.

DETAILED DESCRIPTION OF THE PREFERRED EMBODIMENTS

Figure 2:
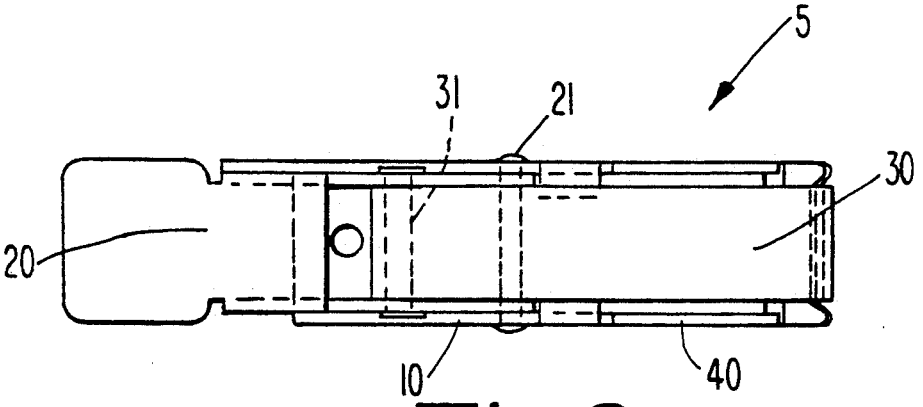
FIG. 2 is a top view of a latch of the present invention.
Figure 1:
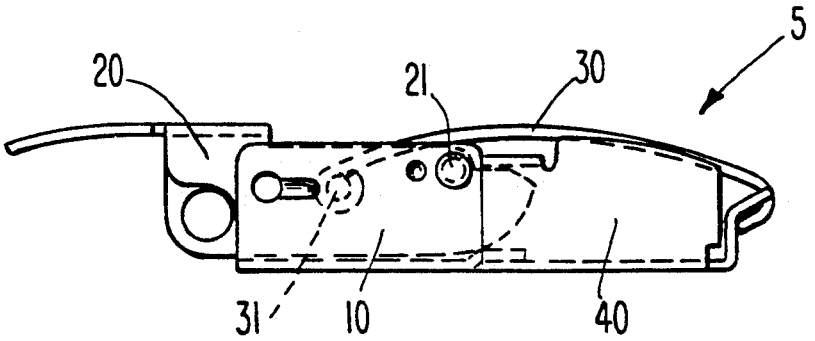
FIG. 1 is a side view of a latch of the present invention.

Referring to the drawings in detail in which like reference numbers represent like elements throughout the several drawings, FIG. 1 shows a side view and FIG. 2 shows a top view of a draw latch 5 in accordance with the present invention. The latch includes a housing 10 and a lever 20 that is rotatably mounted on the housing by a pin 21 or other suitable fastening means. A spring 30 is rotatably mounted on the lever 20 by a pin 31. A keeper 40 engages the spring 30. The base of the housing 10 may be disposed on one panel, while the base of the keeper 40 may be disposed on another panel. When the lever 20 is in the closed position as shown in FIGS. 1 and 2, the engagement of the spring 30 with the keeper 40 draws the keeper 40 toward the housing 10, thereby pulling the respective panels together.

Figure 4:
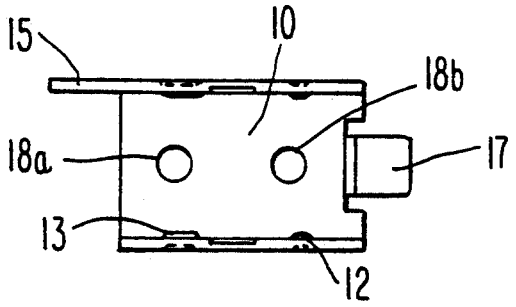
FIG. 4 is a top view of a housing used in a latch of the present invention.
Figure 3:
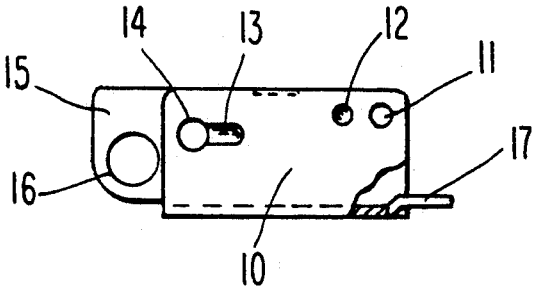
FIG. 3 is a side view of a housing used in a latch of the present invention.

FIG. 3 is a side view and FIG. 4 is a top view of the housing 10. The housing is generally U-shaped and has a base portion that is adapted to contact a door panel or the like. A hole 11 extends through the side portions of the housing and is located relatively far from the base portion of the housing. Indented portions 12 and 13 are provided in the side walls of the housing in order to provide frictional resistance when the lever is rotated within the housing, as more fully described below. A hole 14 is provided through the side walls of the housing 10. As described below, hole 14 is adapted to receive a wire that is used to indicate whether the latch has been opened. An extended portion 15 is provided in one side wall of the housing 10 and includes a hole 16 for receiving a lock. At the opposite end of the housing 10, a tab 17 is provided for aligning the housing with the keeper during operation of the latch. Holes **18*a* and 18*b* are provided in the base of the housing 10** for fastening the housing to a panel.

Figure 6:
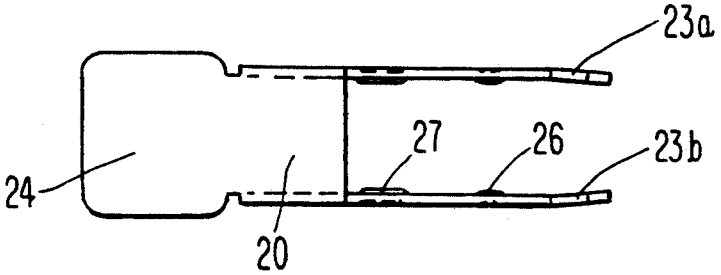
FIG. 6 is a top view of a lever used in a latch of the present invention.
Figure 5:
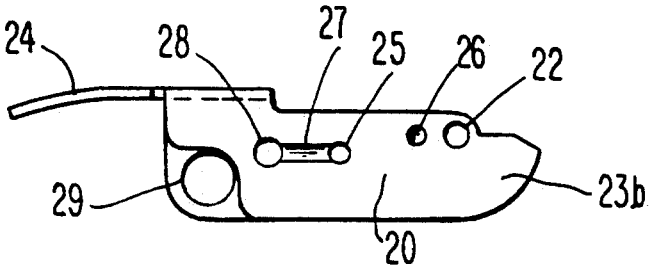
FIG. 5 is a side view of a lever used in a latch of the present invention.

FIG. 5 shows a side view and FIG. 6 shows a top view of the lever 20. A hole 22 is provided near one end of the lever and extends through the side walls of the lever. The hole 22 is adapted to receive a pin (not shown) that is mounted on the housing. Tabs **23*a* and 23*b* are provided at one end of the lever and are adapted to engage the keeper when the latch is fastened, as described further below. A handle portion 24 is provided at the other end of the lever. As shown most clearly in FIG. 5, a hole 25 extends through the side walls of the lever 20. The hole 25 is located closer to the bottom portion of the lever 20 than the hole 22 as shown in FIG. 5. The hole 25 is adapted to receive a pin (not shown) upon which spring 30 rotates. Indentations 26 and 27 are provided in the side walls of the lever 20 and are adapted to receive the indentations 12 and 13, respectively, of the housing 10 when the latch is in the closed position. A hole 28 is provided through the side walls of the lever 20 and is adapted to receive a wire that is used to indicate whether the latch has been opened. A hole 29 is provided in one side wall of the lever 20** for receiving a lock.

Figure 8:
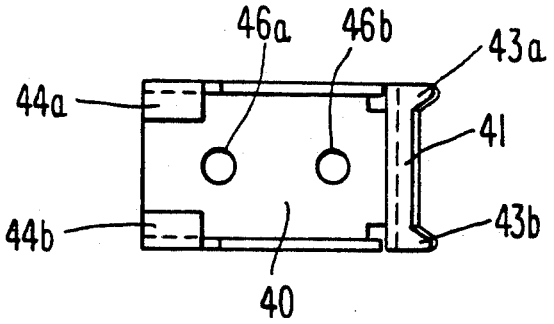
FIG. 8 is a top view of a keeper used in a latch of the present invention.
Figure 7:
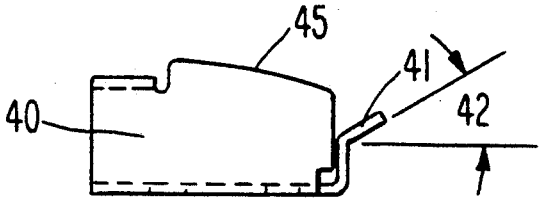
FIG. 7 is a side view of a keeper used in a latch of the present invention.

FIG. 7 shows a side view and FIG. 8 shows a top view of the keeper 40. The keeper 40 is generally U-shaped and includes a bent portion 41 that extends at an angle 42 away from the body of the keeper. The bent portion 41 includes side protrusions 43*a* and 43*b* that prevent unwanted lateral movement of the spring 30 when the latch is fastened. Bent tabs 44*a* and 44*b* are provided in the side walls of the keeper 40. The bent tabs 44*a* and 44*b*, along with the side walls and base of the keeper 40, define a volume into which the tabs 23*a* and 23*b* of the lever 20 are inserted when the latch is in the closed position. A curved edge 45 is provided on the side walls of the keeper 40 and is shaped to generally conform to the curvature of the spring 30 when the latch is fastened. Holes 46*a* and 46*b* are provided in the base of the keeper 40 for fastening the keeper to a panel by means such as screws, bolts or rivets.

Figure 9A:
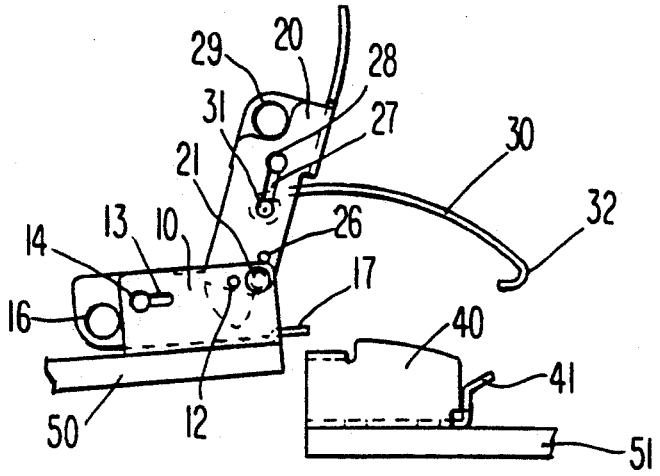
FIGS. 9A–E represent an operating diagram of a latch of the present invention.
Figure 9B:
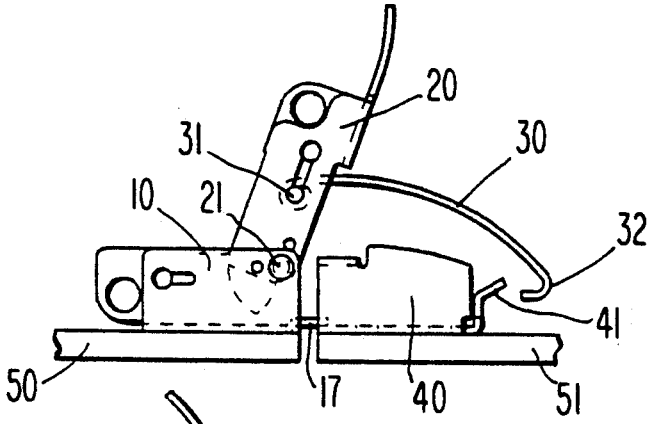
Figure 9C:
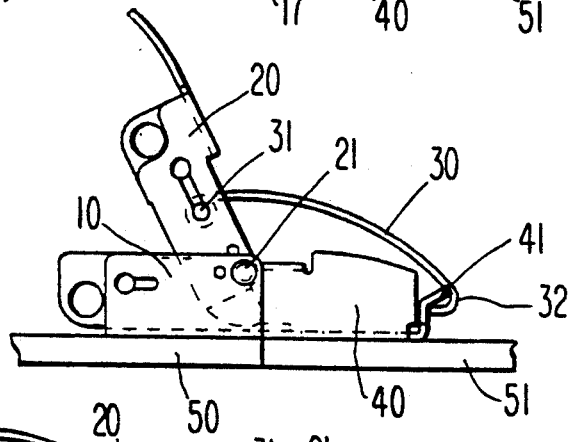
Figure 9D:
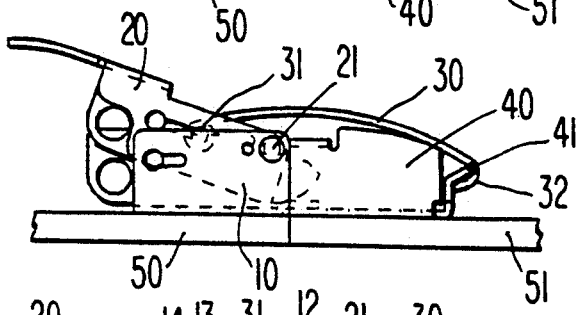
Figure 9E:
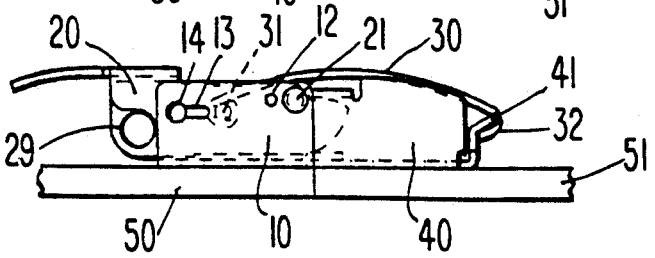

The operation of the draw latch of the present invention is most clearly illustrated in FIGS. 9A-9E. In the open or unfastened position shown in FIG. 9A, panels 50 and 51 are in different planes. The panels 50 and 51 15 could be two separate door panels or a door panel and a frame member. As the panels 50 and 51 are brought into the same plane as shown in FIG. 9B, the tab 17 extending from the housing 10 contacts the base of the keeper 40. In addition to aligning the panels 50 and 51 in the same plane, the tab 17 also acts to align the housing 10 and the keeper 40 in the direction perpendicular to the plane of the drawing. When the lever 20 is rotated counter clockwise around the pin 21 as shown in FIG. 9C, the bent portion 32 of the spring 30 contacts the bent portion 41 of the keeper 40. Upon further rotation as shown in FIG. 9D, the spring 30 flexes, thereby providing additional force to draw the keeper 40 toward the housing 10. The panels 50 and 51 are thereby drawn tightly together. During relative rotation of the lever 20 and the housing 10, the indentations 12 and 13 on the housing 10 contact the side surfaces of the lever 20, thereby providing frictional resistance to the rotation of the lever 20 within the housing 10. When the lever 20 is in the closed position as shown in FIG. 9E, the latch is fully fastened and the panels 50 and 51 are drawn tightly together. In this closed position the pin 31 (around which spring 30 rotates) is located closer to the base of the housing 10 than the pin 21 (around which the lever 20 rotates). Furthermore, the point of contact between the bent portion 32 of the spring 30 and the bent portion 41 of the keeper 40 is closer to the base of the keeper than the pin 21. This configuration provides an over center locking action which tends to keep the lever 20 in the closed position. In the closed position, indentations 12 and 13 disposed on the housing 10 are located within indentations 26 and 27 disposed on the lever 20. Thus, a detent is provided which further acts to secure the latch in the closed position. In the closed position, the hole 14 provided in the side wall of the housing 10 and the hole 28 provided in the side wall of the lever 20 are aligned. A wire or other suitable means may be placed through these holes in order to indicate whether the latch as been opened. The hole 16 of the housing 10 and the hole 29 of the lever 20 are also aligned in the closed position, as shown in FIG. 9E, which permits a lock to be placed through the holes to secure the latch in the closed position.

In accordance with the present invention, when the latch is in the closed position, relative movement of the housing 10 and the keeper 40 in all directions is prevented. The force of the spring 30 prevents relative movement of the panels 50 and 51 away from each other in the plane of the panels. The engagement of the Tabs 23*a* and 23*b* of the lever 20 within the keeper 40 prevents relative movement of the panels in other directions. Thus, substantially all relative movement of the panels is prevented and the latch acts as both a draw latch and a lock bolt latch.

The over center latch of the present invention possesses several advantages over conventional latches. A single latch is provided that achieves the fastening action of both a dead bolt latch and a draw latch. These multiple functions are achieved in accordance with the present invention by a latch assembly of relatively simple design. Few components are necessary in the present latches, which leads to a reduction in cost and inventory. Only four major components are necessary, including a housing, a lever, a spring and a keeper, each of which can be manufactured relatively inexpensively, e.g., by cutting and bending sheet metal to the desired configuration. Considerable cost savings are therefore achieved.

It is understood that the above description of the present invention is susceptible to considerable modifications, changes and adaptations by those skilled in the art, and that such modifications, changes and adaptations are intended to be considered within the scope of the present invention, which is set forth by the appended claims.

We claim:

1. A latch comprising:

(a) a housing having a base portion adapted for fastening to a first panel;

(b) a lever rotatably mounted on said housing and comprising at least one tab portion, said lever being adapted to rotate into a closed position;

(c) a spring rotatably mounted on said lever, wherein when said lever is in said closed position the center of rotation of said spring is closer to said base portion of said housing than the center of rotation of said lever; and (d) a keeper adapted for fastening to a second panel and for engaging said at least one tab portion and said spring when said lever is in said closed position, wherein said keeper includes at least one side wall having a bent portion that defines a volume into which said at least one tab portion of said lever is inserted when said latch is in the closed position.

2. A latch according to claim 1, wherein said housing is generally U-shaped and defines an interior volume, and at least a portion of said lever is disposed within said interior volume of said housing when said lever is in said closed position.

3. A latch according to claim 1, wherein said housing and said lever include means for providing frictional resistance to rotation of said lever.

4. A latch according to claim 1, wherein said housing and said lever include means for locking said lever in said closed position.

5. A latch according to claim 1, wherein said housing includes a tab portion adapted to contact said keeper and align said housing in relation to said keeper.

6. A latch according to claim 1, wherein said spring is a leaf spring.

7. A latch according to claim 6, wherein said spring includes a bent portion located at one end of the spring for engaging said keeper.

8. A latch according to claim 7, wherein said keeper includes a bent portion extending at an angle away from said keeper for engaging said bent portion of said spring.

9. A latch according to claim 1, wherein said keeper is generally U-shaped and at least a portion of said spring is disposed within the interior volume of said U-shaped keeper when said spring is in engagement with said keeper and said lever is in said closed position.

10. A latch according to claim I, wherein said housing said lever, said spring and said keeper are formed from sheet metal.

11. A latch according to claim 1, wherein when said latch is in the closed position relative movement of said first panel and said second panel is substantially prevented in all directions.

12. A latch comprising:

(a) a housing having a base portion adapted for fastening to a first panel;

(b) a lever rotatably mounted on said housing and comprising at least one tab portion, said lever being adapted to rotate into a closed position;

(c) a spring rotatably mounted on said lever, wherein when said lever is in said closed position the center of rotation of said spring is closer to said base portion of said housing than the center of rotation of said lever; and (d) a keeper adapted for fastening to a second panel and for engaging said at least one tab portion of said lever and said spring when said lever is in said closed position, wherein said housing includes a tab portion adapted to contact said keeper and align said housing in relation to said keeper.

13. A latch comprising:

(a) a housing having a base portion adapted for fastening to a first panel;

(b) a lever rotatably mounted on said housing and comprising at least one tab portion, said lever being adapted to rotate into a closed position;

(c) a spring rotatably mounted on said lever, wherein when said lever is in said closed position the center of rotation of said spring is closer to said base portion of said housing than the center of rotation of said lever; and (d) a keeper adapted for fastening to a second panel and for engaging said at least one tab portion of said spring when said lever is in said closed position, wherein said keeper is generally U-shaped and at least a portion of said spring is disposed within the interior volume of said U-shaped keeper when said spring in engagement with said keeper and said lever is in said closed position.

* * * * *